US007462112B1

(12) United States Patent
Sung

(10) Patent No.: US 7,462,112 B1
(45) Date of Patent: Dec. 9, 2008

(54) HIGH ENERGY TRANSFER GOLF CLUB HEAD AND ASSOCIATED METHOD

(76) Inventor: Chien-Min Sung, 64 chung-San Rd., Ying-Ko Factory, Taipei County (TW) 23911

( * ) Notice: Subject to any disclaimer, the term of this patent is extended or adjusted under 35 U.S.C. 154(b) by 54 days.

(21) Appl. No.: 11/647,548

(22) Filed: Dec. 27, 2006

(51) Int. Cl.
*A63B 53/04* (2006.01)

(52) U.S. Cl. ..... 473/346; 473/324

(58) Field of Classification Search ..... None
See application file for complete search history.

(56) References Cited

U.S. PATENT DOCUMENTS

| | | | | | |
|---|---|---|---|---|---|
| 690,940 | A | * | 1/1902 | Febiger | 473/333 |
| 1,091,231 | A | | 3/1914 | Millar | |
| 1,575,364 | A | | 3/1926 | Hodgkins | |
| 1,658,581 | A | | 2/1928 | Tobia | |
| 1,678,637 | A | | 7/1928 | Drevitson | |
| 1,825,244 | A | * | 9/1931 | Nero | 473/333 |
| 2,460,435 | A | | 2/1949 | Schaffer | |
| 2,592,013 | A | * | 4/1952 | Curley | 473/333 |
| 2,823,037 | A | * | 2/1958 | La Ferte | 473/234 |
| 3,589,731 | A | * | 6/1971 | Chancellor, Jr. | 473/333 |
| 3,659,855 | A | | 5/1972 | Hardesty | |
| 4,076,254 | A | | 2/1978 | Nygren | |
| 4,170,357 | A | * | 10/1979 | Greer | 473/333 |
| 4,283,057 | A | * | 8/1981 | Ragan | 473/234 |
| 4,313,607 | A | * | 2/1982 | Thompson | 473/328 |
| 4,461,481 | A | | 7/1984 | Kim | |
| 4,535,990 | A | * | 8/1985 | Yamada | 473/346 |
| 4,681,321 | A | | 7/1987 | Chen et al. | |
| 4,944,515 | A | * | 7/1990 | Shearer | 473/337 |
| 5,000,454 | A | | 3/1991 | Soda | |
| 5,054,784 | A | * | 10/1991 | Collins | 473/327 |
| 5,180,166 | A | | 1/1993 | Schmidt et al. | |
| 5,213,328 | A | | 5/1993 | Long et al. | |
| 5,292,129 | A | | 3/1994 | Long et al. | |
| 5,301,945 | A | | 4/1994 | Schmidt et al. | |
| 5,451,058 | A | * | 9/1995 | Price et al. | 473/340 |
| 5,464,211 | A | * | 11/1995 | Atkins, Sr. | 473/377 |
| 5,480,152 | A | | 1/1996 | Schmidt et al. | |
| 5,547,427 | A | | 8/1996 | Rigal et al. | |
| 5,586,948 | A | * | 12/1996 | Mick | 473/332 |
| 5,613,916 | A | * | 3/1997 | Sommer | 473/332 |
| 5,643,109 | A | | 7/1997 | Rose et al. | |
| 5,697,853 | A | | 12/1997 | Schmidt et al. | |
| 5,776,009 | A | * | 7/1998 | McAtee | 473/333 |
| 5,839,975 | A | | 11/1998 | Lundberg | |
| 5,873,791 | A | * | 2/1999 | Allen | 473/309 |
| 5,888,148 | A | | 3/1999 | Allen | |
| 5,908,356 | A | | 6/1999 | Nagamoto | |
| 5,911,637 | A | * | 6/1999 | Yamagata | 473/333 |

(Continued)

*Primary Examiner*—Gene Kim
*Assistant Examiner*—Alvin A Hunter
(74) *Attorney, Agent, or Firm*—Thorpe North & Western LLP

(57) ABSTRACT

A golf club head and associated method for minimizing flex of a golf club striking face upon impact with a golf ball. The golf club head comprises a shell having front and rear portions. The front portion includes an impact segment with a striking face for impacting a golf ball. The golf club head advantageously includes a laterally positioned, light weight, hollow support member within the shell for reinforcing the striking face. The method for minimizing flex and thereby maximizing force transferred from a golf club head to a golf ball includes supporting the striking face with a shell and a laterally positioned, hollow support member within the shell.

32 Claims, 2 Drawing Sheets

U.S. PATENT DOCUMENTS

| | | | | |
|---|---|---|---|---|
| 5,941,782 | A | 8/1999 | Cook | |
| 6,007,435 | A | 12/1999 | Chern | |
| 6,027,416 | A | 2/2000 | Schmidt et al. | |
| 6,059,669 | A | 5/2000 | Pearce | |
| 6,267,691 | B1 | 7/2001 | Dammen | |
| 6,332,849 | B1 * | 12/2001 | Beasley | 473/332 |
| 6,551,199 | B2 * | 4/2003 | Viera | 473/326 |
| 6,558,271 | B1 | 5/2003 | Beach et al. | |
| 6,872,148 | B2 * | 3/2005 | Lee | 473/131 |
| RE39,178 | E * | 7/2006 | Allen | 473/287 |
| 7,070,514 | B1 * | 7/2006 | Borunda | 473/333 |
| 7,140,977 | B2 * | 11/2006 | Atkins, Sr. | 473/346 |
| 7,351,161 | B2 * | 4/2008 | Beach | 473/334 |
| 7,354,355 | B2 * | 4/2008 | Tavares et al. | 473/329 |

* cited by examiner

HIGH ENERGY TRANSFER GOLF CLUB HEAD AND ASSOCIATED METHOD

FIELD OF THE INVENTION

The present invention relates generally to golf club heads and associated methods for maximizing force transferred from a golf club head to a golf ball upon actuation of the golf club head. Accordingly, the present invention involves the physical and material science fields.

BACKGROUND OF THE INVENTION

Golf is a highly popular sport among people of all ages. As such, the golf equipment industry is constantly seeking to improve the design and performance of golf equipment, specifically golf clubs, to meet the demands of golfers. Importantly, the golf industry is limited in creating new designs of golf clubs by the United States Golf Association (USGA), which has established rules governing the characteristics of golf club heads. For example, the club head must meet certain size specifications, have no holes through the head, and have no appendages through the main body of the club head. Without these rules, technology, not skill, would be the key factor in success of the game.

Of critical importance in the sport of golf is the ability of a golf club to propel a golf ball a long distance in a straight line upon actuation. Throughout the history of golf, there have been numerous attempts to design a golf club head that will maximize distance and decrease spin of a golf ball upon actuation, and this continues today. One such attempt to maximize distance is to create a golf club head with a flexible striking face that deforms or deflects upon impact with a golf ball and thereafter immediately rebounds back to its original, non-deflected shape thereby propelling the golf ball forward. However, such deflection or deformation may undesirably increase the contact area between the golf ball and the golf club face. Additionally, such deflection may increase the contact time between the golf ball and the golf club face. An increase in either or both the contact area and the contact time is likely to result in an increase in the spin of the golf ball, thereby causing the golf ball to travel in a curved trajectory as opposed to traveling in a straight line. Additionally, an increase in the contact area and the contact time may decrease the amount of energy that is transferred to the golf ball.

It has been recognized that it would be desirable to provide a golf club head that is relatively inexpensive to manufacture, and that will have minimal or no deflection of the golf club face upon impact with a golf ball, thereby increasing the distance and reducing the spin of a golf ball. As a result, designs of golf club heads that will satisfy these desirable qualities are continually being sought.

SUMMARY OF THE INVENTION

Accordingly, the present invention provides a high energy golf club head and a method of minimizing flex of a golf club striking face upon impact with a golf ball, thereby maximizing force transferred from a golf club head to the golf ball. In one aspect, a high energy golf club head is provided. The high energy golf club head includes a shell defining an interior space. The shell has both front and rear portions. The front portion includes an impact segment with a striking face for impacting a golf ball. The high energy transfer golf club head also includes a laterally positioned, light weight, hollow support member within the shell for reinforcing the striking face. The support member has continuous contact with an inner surface of the front portion of the shell and extends from the front portion to an inner surface of the rear portion of the shell. The hollow support member includes an anterior flared portion for reinforcing the striking face. The anterior flared portion is in peripheral contact with the inner surface of the front portion of the shell. The hollow support member also includes a narrow portion integral with the anterior flared portion which extends away from the inner surface of the front portion of the shell. Finally, the hollow support member includes a posterior flared portion that is integral with the narrow portion and is in continuous contact with the inner surface of the rear portion of the shell.

In another aspect, a method is provided whereby force transferred from a golf club head to a golf ball is maximized by minimizing flex of a golf club striking face upon impact with a golf ball. This method includes supporting the striking face with a shell and a laterally positioned, hollow support member within the shell. The shell defines an interior space and has a front portion with an impact segment and a rear portion. The support member also has continuous contact with an inner surface of the front portion of the shell and extends from the front portion of the shell to an inner surface of the rear portion of the shell.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Definitions

Figure 1:
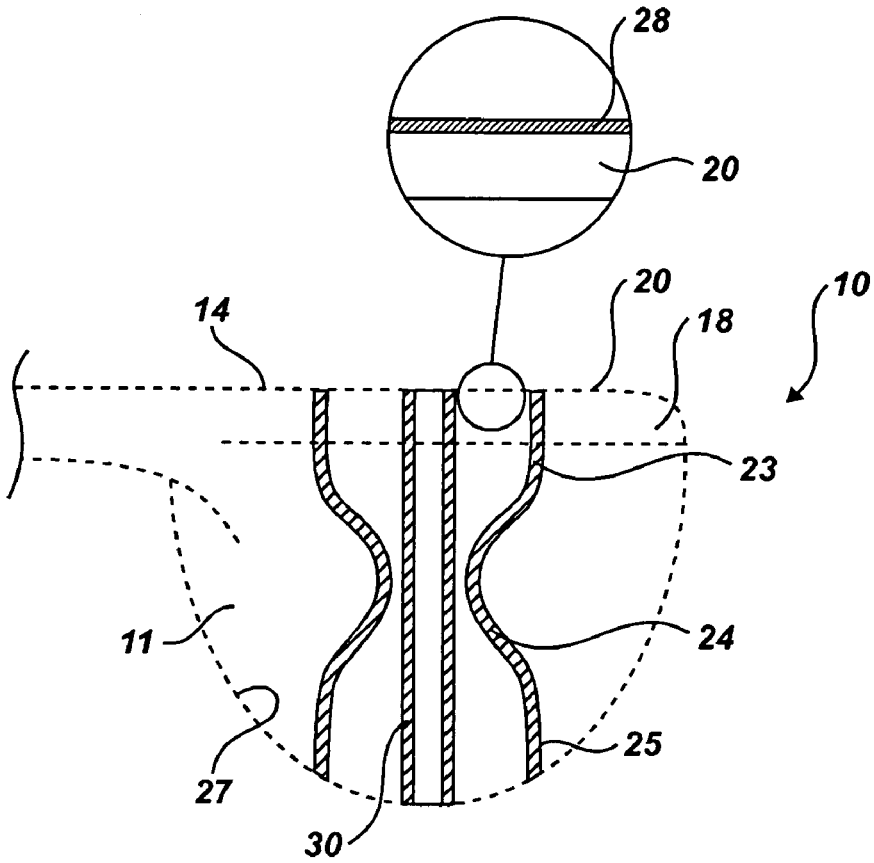
FIG. 1 is a top sectional view of a high energy transfer golf club head including a magnified view of the striking face of the golf club head in accordance with one embodiment of the present invention.
Figure 2:
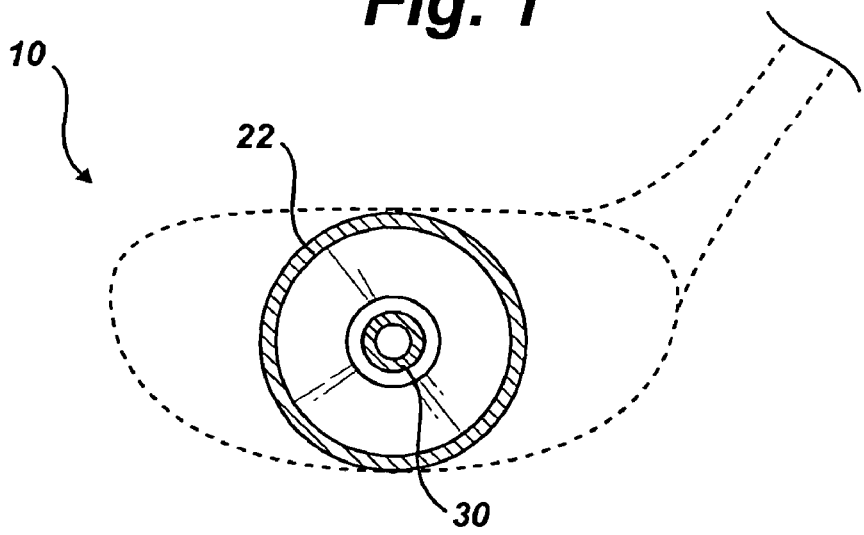
FIG. 2 is a front sectional view of a high energy golf club head in accordance with one embodiment of the present invention wherein the discrete walls comprising the support member are joined.

In describing and claiming the present invention, the following terminology will be used in accordance with the definitions set forth below.

The singular forms "a," "an," and, "the" include plural referents unless the context clearly dictates otherwise. Thus, for example, reference to "a particle" includes reference to one or more of such particles, and reference to "the metal" includes reference to one or more of such metals.

As used herein, "support member" refers to a pair of symmetrical discrete walls having a space therebetween. The walls, being curved in nature, may be joined at their outermost edges to one another so as to eliminate some or all of the space therebetween.

As used herein, "diamond" refers to a crystalline structure of carbon atoms bonded to other carbon atoms in a lattice of tetrahedral coordination known as $sp^3$ bonding and includes amorphous diamond. Specifically, each carbon atom is surrounded by and bonded to four other carbon atoms, each located on the tip of a regular tetrahedron. The structure and nature of diamond, including its physical properties are well known in the art.

As used herein, "metallic" refers to a metal, or an alloy of two or more metals. A wide variety of metallic materials is known to those skilled in the art, such as aluminum, copper, chromium, iron, steel, stainless steel, titanium, tungsten, zinc, zirconium, molybdenum, etc., including alloys and compounds thereof.

As used herein, "plastic" refers to plastics such as polycarbonates, polysulfides, polyimides and polybutylene terephthalate. These plastics exhibit superior mechanical and thermal properties and are known to regain their original shape following deformation. The structure and nature of engineering plastics, including its physical properties is well known in the art.

As used herein, "composite" refers to engineered materials made from two or more separate materials. Specifically, composites typically include a strong fibrous material, such as carbon fiber or fiberglass, combined with a resin such as polyester or epoxy, which bind the fibers in the fibrous material together. The structure, nature and physical properties of composites are well known in the art.

As used herein, "substantially" refers to situations close to and including 100%. Substantially is used to indicate that, though 100% is desirable, a small deviation there from is acceptable. For example, substantially all asperities includes groups of all asperities and groups of all asperities minus a relatively small portion of asperities.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value. Furthermore, such an interpretation should apply regardless of the breadth of the range or the characteristics being described.

The Invention

FIG. 1. is a top sectional view of a high energy transfer golf club head 10 in accordance with one embodiment of the present invention comprising a shell 12 defining an interior space 11. The shell 12 has a front portion 14 and a rear portion 16. The front portion 14 includes an impact segment 18 with a striking face 20 for impacting a golf ball. The high energy transfer golf club head also comprises a laterally positioned, light weight, hollow support member 22 within the shell 12 for reinforcing the striking face 20. The support member 22 has continuous contact with an inner surface of the front portion 26 of the shell and extends from the front portion 14 to an inner surface of the rear portion 27 of the shell. The hollow support member 22 comprises an anterior flared portion 23, a narrow portion 24, and a posterior flared portion 25. The anterior flared portion 23 reinforces the striking face 20 and is in peripheral contact with the inner surface of the front portion 26 of the shell 12. The narrow portion 24 of the hollow support member is integral with the anterior flared portion 23 and extends away from the inner surface of the front portion 26 of the shell 12. The posterior flared portion 25 is integral with the narrow portion and is in contact with the inner surface of the rear portion 27 of the shell 12. In a preferred embodiment of the present invention, the posterior flared portion 25 of the support member 22 is welded to the inner surface of the rear portion of the shell 27.

The hollow support member 22 provides the primary impact support in the golf club head 10 of the present invention. The hollow support member 22 is able to withstand the loads incurred when the golf club head 10 comes into contact with the golf ball. Desirably, the hollow support member together with the striking face 20 should bear at least 60% of the load upon impact between the club head 10 and the golf ball. Accordingly, in one embodiment of the present invention, the hollow support member 22 comprises a high strength material having yield strength of greater than about 100 MPa. In a preferred embodiment the high strength material comprising the hollow support member 22 is selected from the group consisting of titanium, steel, zirconium, aluminum, magnesium and mixtures and composites thereof. Currently, the most preferred material comprising the hollow support member includes titanium because of its high strength to low weight ratio. In one embodiment the thickness of the hollow support member 22 can be uniform throughout the entire member. Alternatively, the thickness can vary throughout the hollow support member for purposes of strategically distributing mass to control the performance of the club head.

Since the hollow support member 22 provides the primary impact support, the load placed on the shell 12 is limited. Desirably the shell 12 should bear no more than 40% of the total load incurred upon impact between the golf club head 10 and the golf ball. Therefore, the shell 12 can comprise materials that are lighter, thinner and weaker than the materials comprising the hollow support member 22. However, the materials comprising the shell 12 must be sufficiently strong to withstand the acceleration force of the swing of the golf club and the shock upon impact between the golf club head 10 and the golf ball. Desirably, the golf club head 10 of the present invention comprises a shell 12 that is lighter in weight than the shells of conventional golf club heads. Examples of suitable materials comprising the shell 12 include plastics and composites. Other suitable materials include magnesium, aluminum, titanium and their alloys wrapped in engineering plastics.

In a further aspect of the high energy transfer golf club head 10 of the present invention, the striking face 20 comprises diamond. Diamond is ideal for the striking face of the present invention because of its exceptional hardness and toughness. In a preferred embodiment of the present invention, the striking face 20 comprises polycrystalline diamond (PCD). PCD is not subject to yield or plastic deformation under stress. Therefore, upon impact with a golf ball, the striking face 20 comprising PCD will not deflect, but rather will maintain its shape thereby limiting the contact surface between the golf club head 10 and the golf ball.

In yet another preferred embodiment of the present invention, the striking face 20 comprising PCD is coated with diamond-like carbon coating (DLC) 28 as is shown in the magnified view of FIG. 1. In this embodiment, diamond to diamond bonds are formed between the PCD and DLC. Coating of metal substrates such as metallic golf club striking faces with DLC is not a new concept. However, this arrangement is not ideal. Metallic striking faces are generally deflectable upon impact with a golf ball. Upon deflection of a metallic striking face, the DLC coating begins to detach from the striking face and eventually flakes off. The high energy transfer golf club head 10 of the present invention overcomes this deficiency because (1) deflection of the striking face 20 is minimized where the striking face comprises PCD, and (2) strong diamond to diamond bonds are formed between the striking face comprising PCD and the DLC coating 28.

In one aspect of the present invention, the DLC coating 28 has a thickness from about 0.1 μm to about 10 μm. Additionally, the DLC of the coating 28 has a grain size less than about 0.1 μm. One reason that the use of DLC on the striking face 20 of the golf club head 10 is desirable, especially with respect to long game golf clubs, is that DLC has a very low frictional coefficient, i.e., 0.1 or less. This low frictional coefficient is comparable to Teflon or other lubricants. Low friction between the striking face 20 of the golf club head 10 and the golf ball reduces heat and spin or angular momentum that a golf ball normally experiences after impact with a club head. Therefore, more forward or directional momentum is transferred from the golf club head 10 to the golf ball. In other words, the force behind a golf club swing is not wasted on angular momentum or generated heat.

Another advantage of the present invention is that to obtain a low frictional coefficient, the user is not required the use of a liquid lubricant as is known in the art. The use of a liquid lubricant can be messy and if the golfer is not careful, the lubricant can get on the golfer's hands causing slippage on subsequent golf swings. Further, since the lubricant is not integrated into the golf club head, some lubricant will pass from the golf club head to the ball. This will cause the ball to fly unevenly or asymmetrically. The present invention provides a golf club head 10 having a low friction coefficient (0.1 or less) on the striking face without the disadvantages associated with the use of lubricants.

Still yet another advantage of coating the striking face 20 with DLC is that polishing of the golf club head is minimized, if not eliminated, since DLC is naturally a relatively smooth substance which does not require polishing.

Figure 3:
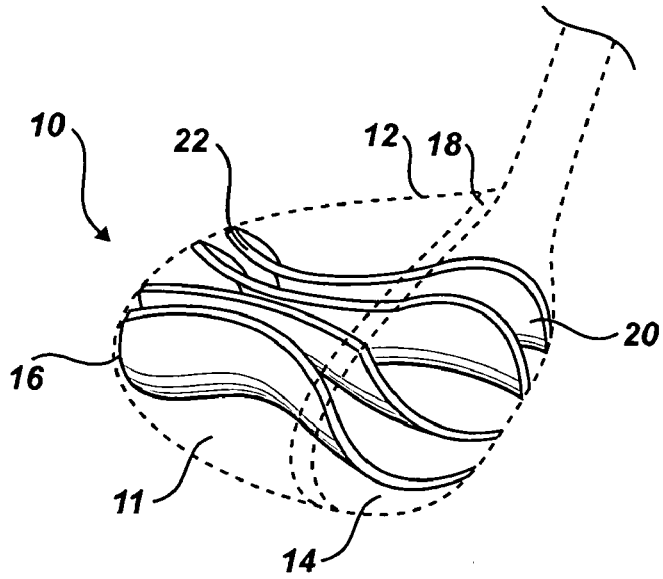
FIG. 3 is a perspective view of a high energy transfer golf club head in accordance with another embodiment of the present invention, wherein the discrete walls comprising the support member are not joined.
Figure 4:
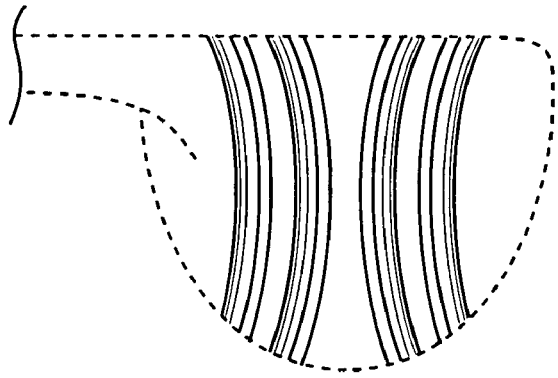
FIG. 4 is a top sectional view of a high energy golf club head in accordance with one embodiment of the present invention.
Figure 5:
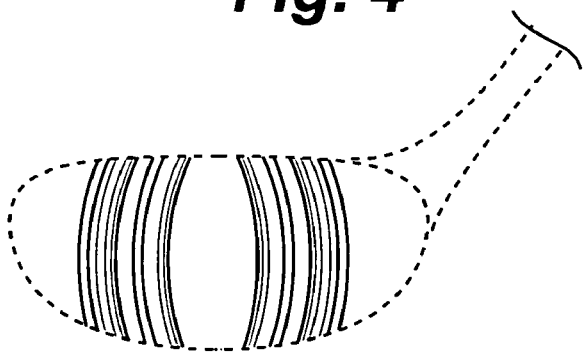
FIG. 5 is a front sectional view of a high energy golf club head in accordance with one embodiment of the present invention.

There are multiple structural arrangements that can be adopted for purposes of reinforcing the striking face 20 of the golf club head of the present invention when a load is applied thereto resulting from impact with a golf ball. In one embodiment of the present invention, the striking face 20 has a circumference equal to a maximum circumference of the anterior flared portion of the hollow support member 23. In this embodiment, there are no edges of the striking face 20 overlapping the circumference of the hollow support member 22 that are thereby unsupported and subject to deflection upon impact with a golf ball. Preferably, the striking face 20 has a thickness sufficient to prevent deformation of the striking face when a load is applied resulting from impact with a golf ball. In yet another embodiment, the high energy transfer golf club head of the present invention further comprises a secondary lateral support member 30 positioned within the hollow support member 22. The perimeter of the secondary lateral support member 30 can be parallel to a perimeter of the hollow support member 22 as is shown in FIG. 3. Alternatively, the perimeter of the secondary lateral support member can have a shape that is different from the shape of the hollow support member as is shown in FIG. 1. In a preferred embodiment, the secondary lateral support member 30 is cylindrical in shape. Additionally, the secondary lateral support member 30 can be either solid or hollow as is shown in FIG. 1. Desirably the secondary lateral support member 30 will be able to withstand the loads incurred when the golf club head comes into contact with the golf ball. Accordingly, in one embodiment of the present invention, the secondary lateral support member 22 comprises a high strength material having yield strength of greater than about 100 MPa. In a preferred embodiment the high strength material comprising the secondary lateral support member 30 is selected from the group consisting of titanium, steel, zirconium, aluminum, magnesium and mixtures and composites thereof. Currently, the most preferred material comprising the secondary lateral support member 30 includes titanium because of its high strength to low weight ratio.

The present invention also provides a method of minimizing flex of a golf club striking face 20 upon impact with a golf ball, thereby maximizing force transferred from a golf club head 10 to the golf ball. The method of the present invention comprises supporting the striking face 20 with a shell 12 and a laterally positioned, hollow support member 22 within the shell 12. The shell 12 defines an interior space 11 and includes a front portion 14 and rear portion 16. The shell 12 further includes an impact segment 18. The support member 22 has continuous contact with an inner surface of the front portion of the shell 26 and extends therefrom to an inner surface of the rear portion of the shell 27. The hollow support member 22 is supported between the front portion of the shell 14 and the rear portion of the shell 16. Thus, the load incurred upon impact between the club head 10 and a golf ball is supported by the compression force of the support member 22, as opposed to a shearing force of the striking face 20. Consequently, deflection of the striking face 20 is greatly reduced or eliminated.

In the method of the present invention the hollow support member 22 may further include an anterior flared portion 23 for reinforcing the impact segment 18, a narrow portion 24 integral with the anterior flared portion 23, and a posterior flared portion 25. The anterior flared portion 23 is in peripheral contact with the inner surface of the front portion of the shell 26. The narrow portion 24 is integral with the anterior flared portion 23 and extends away from the inner surface of the front portion of the shell 26. The posterior flared portion 25 of the support member is in contact with the inner surface of the rear portion of the shell 27. Preferably, the posterior flared portion 25 of the support member is welded to the inner surface of the rear portion of the shell.

The hollow support member 22 supporting the striking face 20 of the golf club head 10 comprises a high strength material having yield strength of greater than about 100 MPa. The high strength material is selected from the group consisting of titanium, zirconium, aluminum and mixtures and composites thereof. Titanium is currently the most preferred material comprising the secondary lateral support because of its high strength to low weight ratio.

To further minimize flex of a golf club striking face 20 upon impact with a golf ball, the method of the present invention may include contacting the golf ball with a striking face 20 that comprises diamond. Diamond is an ideal material for the striking face 20 of the present invention because of its exceptional hardness and toughness. Preferably, the striking face 20 comprises polycrystalline diamond (PCD). PCD is not subject to yield or plastic deformation under stress. Therefore, upon impact with a golf ball, the striking face comprising PCD will not deflect, but rather will maintain its shape thereby limiting the contact surface between the golf club head and the golf ball. The reduction in contact surface between the golf club head and the golf results in an increase in the flying distance the golf ball travels. It has been demonstrated by machine that utilizing a striking face comprising PCD can increase the flying distance of a golf ball by 20 meters. Furthermore, if the striking face does not deflect, an additional 20 meters of distance can be expected.

In one preferred embodiment of the present invention, the striking face 20 comprising PCD is coated with diamond-like carbon coating (DLC) 28 as is shown in the magnified view of FIG. 1. In this embodiment, diamond to diamond bonds are formed between the PCD and DLC. The coating of metal substrates such as metallic golf club striking faces with DLC is not a new concept. However, this arrangement is not ideal. Metallic striking faces are generally deflectable upon impact with a golf ball. Upon deflection of a metallic striking face, the DLC coating begins to detach from the striking face and eventually flakes off. The method of the present invention overcomes this deficiency because (1) deflection of the striking face 20 is minimized where the striking face comprises PCD, and (2) strong diamond to diamond bonds are formed between the striking face comprising PCD and the DLC coating 28, which inhibit flaking of the DLC coating. Desirably, the DLC coating 28 has a thickness from about 0.01 μm to about 10 μm, and the DLC has a grain size less than about 0.1 μm.

One advantage of coating the striking face 20 with DLC is that diamond-like carbon (DLC) has a very low frictional coefficient, i.e., 0.1 or less. This low frictional coefficient is comparable to Teflon or other lubricants. Low friction between the striking face of a golf club head and the golf ball reduces heat and spin or angular momentum that a golf ball normally experiences after impact with a club head. Therefore, more forward or directional momentum is transferred from the golf club to the golf ball. In other words, the force behind a golf club swing is not wasted on angular momentum or generated heat.

Another advantage of the present invention is that the golfer is not required to use liquid lubricant as is known in the art. The use of a liquid lubricant can be messy and if the golfer is not careful, the lubricant can get on the golfer's hands causing slippage on subsequent golf swings. Further, since the lubricant is not integrated into the golf club head, some lubricant will pass from the golf club head to the ball. This will cause the ball to fly unevenly or asymmetrically. The present invention provides a golf club head 10 having a low friction coefficient (0.1 or less) on the striking face 20 without the disadvantages associated with the use of lubricants. Still yet another advantage of coating the striking face 20 with DLC is that polishing of the golf club head is minimized, if not eliminated, since DLC is naturally a relatively smooth substance which does not require polishing The method of minimizing flex can be further accomplished by providing additional structural support features to the golf club head 10. For example, in one embodiment the striking face 20 has a circumference equal to a maximum circumference of the anterior flared portion 23 of the hollow support member 22. This ensures that no edge of the striking face 20 is without support and subject to deflection upon impact with a golf ball. In another embodiment the striking face 20 has a thickness sufficient to prevent deformation of the striking face upon impact with a golf ball. Naturally, flexibility of the striking face 20 will decrease as the thickness of the striking face increases.

Deflection of the striking face 20 upon impact with a golf ball can be further minimized by supporting the striking face with a secondary lateral support member 30 positioned within the hollow support member 22. In one embodiment, a perimeter of the secondary lateral support member 30 is parallel to a perimeter of the hollow support member 22. In another embodiment, a perimeter of the secondary lateral support member 30 is not parallel to the hollow support member 22 and is in a shape different from that of the hollow support member. For example, the secondary support member 30 can be in the shape of a hollow or solid cylinder. Whereas the hollow support member 22 always comprises an anterior flared portion 23 and a posterior flared portion 25 having a narrow portion 24 in the middle thereof.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A high energy transfer golf club head comprising:

a shell defining an interior space, said shell having a front portion and a rear portion, said front portion including an impact segment with a striking face for impacting a golf ball; and a laterally positioned, light weight, hollow support member within the shell for reinforcing the striking face, said support member having continuous contact with an inner surface of the front portion of the shell and extending from the front portion to an inner surface of the rear portion of the shell; said hollow support member comprising:

(a) an anterior flared portion for reinforcing the striking face, said anterior flared portion being in peripheral contact with the inner surface of the front portion of the shell;

(b) a narrow portion integral with the anterior flared portion and extending away from the inner surface of the front portion of the shell; and (c) a posterior flared portion integral with the narrow portion and in contact with the inner surface of the rear portion of the shell.

2. The high energy transfer golf club head of claim 1, wherein the hollow support member comprises a high strength material having yield strength of greater than about 100 MPa.

3. The high energy transfer golf club head of claim 2, wherein the high strength material is selected from the group consisting of titanium, zirconium, aluminum and mixtures and composites thereof.

4. The high energy golf club head of claim 3, wherein the hollow support member comprises titanium.

5. The high energy golf club head of claim 1, wherein the striking face comprises diamond.

6. The high energy transfer golf club head of claim 5 wherein the striking face comprises polycrystalline diamond (PCD).

7. The high energy transfer golf club head of claim 6, wherein the striking face is coated with diamond-like carbon coating (DLC), and diamond to diamond bonds are formed between the PCD and DLC.

8. The high energy golf club head of claim 7, wherein the DLC has a thickness from about 0.1 μm to about 10 μm, and wherein said diamond-like carbon (DLC) of said coating has a grain size less than about 0.1 μm.

9. The high energy golf club head of claim 8, wherein the striking face has a frictional co-efficient of less than 0.1.

10. The high energy transfer golf club head of claim 1 wherein the striking face has a circumference equal to a maximum circumference of the anterior flared portion of the hollow support member.

11. The high energy transfer golf club head of claim 1, wherein the striking face has a thickness sufficient to prevent deformation of the striking face upon impact with a golf ball.

12. The high energy transfer golf club head of claim 1, further comprising a secondary lateral support member positioned within the hollow support member.

13. The high energy transfer golf club head of claim 12, wherein a perimeter of the secondary lateral support member is parallel to a perimeter of the hollow support member.

14. The high energy transfer golf club head of claim 12, wherein the secondary lateral support member is hollow.

15. The high energy transfer golf club head of claim 12, wherein the secondary lateral support member is solid.

16. The high energy transfer golf club head of claim 1, wherein the posterior flared portion of the support member is welded to the inner surface of the rear portion of the shell.

17. A method of minimizing flex of a golf club striking face upon impact with a golf ball, thereby maximizing force transferred from a golf club head to the golf ball, said method comprising:

supporting the striking face with a shell and a laterally positioned, hollow support member within the shell; said shell defining an interior space and having a front and rear portion, and further including an impact segment; said support member having continuous contact with an inner surface of the front portion of the shell and extending from the front portion of the shell to an inner surface of the rear portion of the shell;

wherein the hollow support member further includes:

(a) an anterior flared portion for reinforcing the impact segment, the anterior flared portion being in peripheral contact with the inner surface of the from portion of the shell;

(b) a narrow portion integral with the anterior flared portion and extending away from the inner surface of the front portion of the shell; and (c) a posterior flared portion integral with the narrow portion and in contact with the inner surface of the rear portion.

18. The method of claim 17, wherein the hollow support member comprises a high strength material having yield strength of greater than about 100 MPa.

19. The method of claim 18, wherein the high strength material is selected from the group consisting of titanium, zirconium, aluminum and mixtures and composites thereof.

20. The method of claim 19, wherein the hollow support member comprises titanium.

21. The method of claim 17, wherein the striking face comprises diamond.

22. The method of claim 21, wherein the striking face comprises polycrystalline diamond (PCD).

23. The method of claim 22, wherein the striking face is coated with diamond-like carbon coating (DLC), and diamond to diamond bonds are formed between the PCD and DLC.

24. The method of claim 23, wherein the DLC has a thickness from about 0.01 μm to about 10 μm, and wherein said DLC of said coating has a grain size less than about 0.1 μm.

25. The method of claim 24, wherein the striking face has a frictional coefficient of less than about 0.1.

26. The method of claim 17, wherein the striking face has a circumference equal to a maximum circumference of the anterior flared portion of the hollow support member.

27. The method of claim 17, wherein the striking face has a thickness sufficient to prevent deformation of the striking face upon impact with a golf ball.

28. The method of claim 17, further comprising the step of supporting the striking face with a secondary lateral support member positioned within the hollow support member.

29. The method of claim 28, wherein a perimeter of the secondary lateral support member is parallel to a perimeter of the hollow support member.

30. The method of claim 28, wherein the secondary lateral support member is hollow.

31. The method of claim 28, wherein the secondary lateral support member is solid.

32. The method of claim 17, wherein the posterior flared portion of the support member is welded to the inner surface of the rear portion of the shell.

* * * * *